United States Patent [19]

Caruso et al.

[11] 4,407,507

[45] Oct. 4, 1983

[54] PORTABLE SOCCER GOAL

[76] Inventors: Vincent C. Caruso, 120 Old Country Rd., Melville, N.Y. 11747; Andrew Caruso, 104 Wyandanch Blvd., Commack, N.Y. 11725

[21] Appl. No.: 280,327

[22] Filed: Jul. 6, 1981

[51] Int. Cl.[3] ..... A63B 63/00

[52] U.S. Cl. ..... 273/400; 403/116

[58] Field of Search ..... 273/398–402, 273/411, 410, 395, 127 B, 181 A, 181 F, 294 B, 26 A, 1.5 R, 55 D; 403/116

[56] References Cited

U.S. PATENT DOCUMENTS

| | | | |
|---|---|---|---|
| 870,910 | 11/1907 | Splittgerber | 403/116 X |
| 3,195,898 | 7/1965 | Respini | 273/26 A X |
| 3,602,504 | 8/1971 | Chapman | 273/411 X |
| 3,616,469 | 11/1971 | Injeski | 403/116 X |
| 3,642,282 | 2/1972 | Frischman | 273/127 B |
| 3,698,712 | 10/1972 | Pero | 273/26 A |
| 3,716,234 | 2/1973 | Lancellotti | 248/326 X |
| 4,116,446 | 9/1978 | Thompson | 273/181 F |
| 4,127,272 | 11/1978 | Pennell | 273/398 |
| 4,160,549 | 7/1979 | Simpson | 273/402 X |
| 4,169,598 | 10/1979 | Taylor | 273/400 |

FOREIGN PATENT DOCUMENTS

| | | | |
|---|---|---|---|
| 1910844 | 9/1970 | Fed. Rep. of Germany | 273/400 |
| 2321436 | 11/1974 | Fed. Rep. of Germany | 273/29 B |
| 1341549 | 9/1963 | France | 273/1.5 R |
| 1069207 | 5/1967 | United Kingdom | 273/395 |

*Primary Examiner*—Paul E. Shapiro
*Attorney, Agent, or Firm*—Richard L. Miller

[57] ABSTRACT

A portable soccer goal has a pair of stationary posts, and a pair of leg braces pivoted to the upper ends of the posts, one brace for each post. The upper ends of the posts are connected by removably connected cross pieces defining the upper boundary of the goal. A net wrapped about the posts and braces and supported on the top of the posts is also provided such that the mouth of the goal is defined between the leg braces. Shoes are provided for the bottom of the posts and braces, each shoe having a spike for insertion into the ground to erect the goal. The cross pieces are connected by snap buttons and arcuate slots so that the posts may be rotated relative to the cross pieces.

1 Claim, 5 Drawing Figures

PORTABLE SOCCER GOAL

BACKGROUND OF THE INVENTION

The present invention is directed to a goal for use in the game of soccer, which goal is designed to be portable for use at different locations and at different times.

The game of soccer is experiencing an awakening in this country and is played by youngsters to an ever greater degree. In some localities, soccer is replacing baseball as the chosen sport to be played.

However, since soccer is a relatively recent sport to this country, there is a lack of official-sized playing fields and the necessary goal needed to play the game. However, since soccer is a simple sport requiring little equipment, other than a playing field, a ball, and a goal, it is possible to convert many areas such as football fields, baseball fields, back yards, playground areas, etc., to a soccer-type field by employing thereon a soccer goal. It is often the case that such goals are makeshift ones, sometimes using only a couple of barriers to define therebetween the goal.

SUMMARY OF THE INVENTION

It is, therefore, the primary object of the present invention to provide a portable soccer goal for use in the game of soccer, which goal may be readily and easily assembled for use at a particular location at which a game of soccer is to be played.

It is a further object of the present invention to provide such a portable soccer goal that is lightweight and which is able to be broken down into constituent parts for carrying and storing.

It is still another object of the present invention to allow for the goal mouth of the portable soccer goal to be adjustable to adapt to the particular playing conditions.

It is still another object of the present invention to provide such a soccer goal which may be erected easily and in a manner that allows for such alignment of the goal posts.

To this end, the portable soccer goal of the present invention is provided with a pair of upstanding, erect stationary posts which are insertable into the ground or on another support plane. Each stationary post has pivotted to its upper end a leg brace, so that when a net is wrapped around the leg braces and the stationary posts, the space defined between the leg braces constitutes the goal mouth and the net extending between the stationary posts constitutes the rear of the goal.

A cross piece connecting the two upper ends of the stationary posts constitutes the upper boundary of the goal. The net is held in place by projecting knobs on the stationary posts, which net is draped over the cross piece.

The cross piece is preferably made of three telescoping sections, each section being connected to another by a retractable snap button. Some of the ends of the cross pieces have arcuate slots to receive the buttons, so that the stationary posts may be rotated relative thereto. Such rotation allows for the goal to be erected in an easy and fast manner.

The lower ends of the stationary posts and leg braces are designed to receive a shoe for mounting the goal on the ground. In an alternative form, a support plate is provided that has a flat bottom surface and which receives on its top surface the lower ends of the stationary posts and leg braces so that the goal may be set up on a hard surface, such as concrete.

BRIEF DESCRIPTION OF THE DRAWING FIGURES

The invention will be more readily understood with reference to the accompanying drawing, wherein FIG. 1 is a perspective view of the portable soccer goal of the invention, shown partly erected;

DETAILED DESCRIPTION OF THE PREFERRED EMBODIMENT

Figure 2:
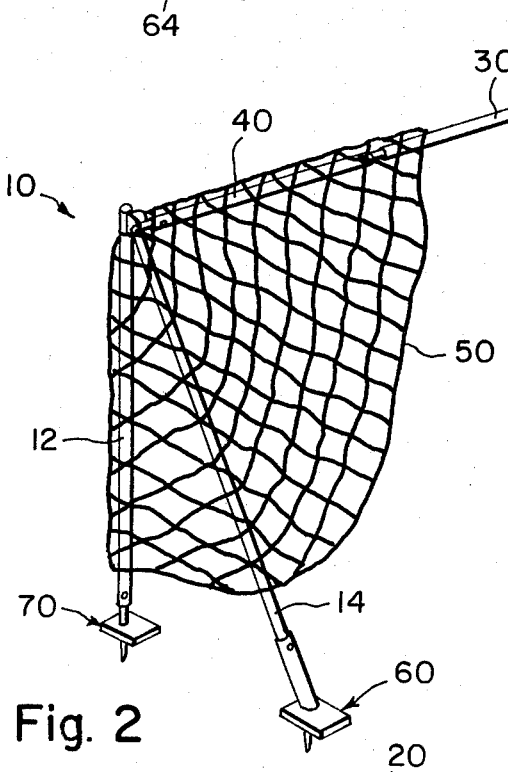
FIG. 2 is a perspective view of the invention shown fully erected, with the net broken away for clarity.

Referring now to the drawing, the portable soccer goal of the invention is generally indicated by reference numeral 10. The portable soccer goal 10 is constructed to include a pair of stationary posts 12, 12' which stand erect in the fully operational mode, as shown in FIG. 2. Stationary posts 12, 12' has pivotted, at its upper end, leg braces 14, 14'. Each leg brace is pivotted to the upper end of a respective stationary post by pivot bolt 16. The upper end of each leg brace is bifurcated and receives fin 18 of the stationary post, which fin forms an integral part of the stationary post.

Figure 4:
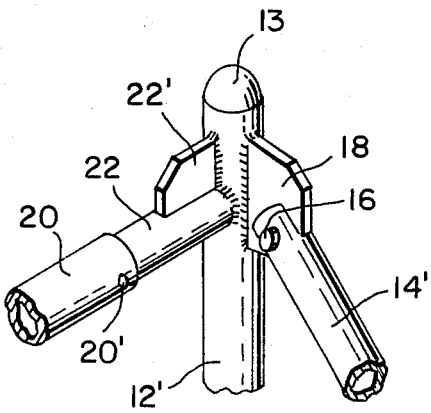
FIG. 4 is a detail view of the corner post joint construction of the invention.

Extending between the upper ends of the stationary posts 12, 12' are a plurality of cylindrical, hollow cross rails. In the preferred form of the invention shown in FIG. 1, three such cross rails are used, each being attachable and detachable to each other and/or to a respective stationary post. The first cross rail 20 is provided with a circular opening (FIG. 4) for receiving a retractable snap button, or rounded protuberance, 20' provided at the remote end of an extension sleeve 22 attached to the upper end of the stationary post 12'. The extension sleeve 22 is welded to the upper end of the stationary post 12' and is butressed with a fin 22'. The retractable snap button 20' is of conventional design, and is dimensioned so as to fit snugly within the opening. The other end of the cross rail 20 is provided with an extension sleeve 24 similar in construction to the sleeve 22, and has a retractable snap button 24' similar to the button 20'. The extension sleeve 24 is telescopingly received in the second, middle cross rail 30, which cross rail 30 has an arcuate slot 32 formed at one end thereof. The arcuate slot 32 receives the snap button 24' therein, in a well known manner so that the cross rail 20 may be rotated relative to the cross rail 30, which rotation aids in the erection and positioning of the portable soccer goal, as explained below.

The other end of the cross rail 30 is provided with a sleeve extension (not shown) similar in construction to the sleeve 24, and has a snap button thereon similar in construction to the snap button 24'. The snap button and sleeve of the cross rail 30 are, in turn, telescopingly received in the end of the third cross rail 40 remote from the end attached to the stationary post 12. The third cross rail 40 is different from the other two in that there is no extension sleeve provided therefor, but each end is open. The upper end of the stationary post 12 is provided with a similar sleeve extension and fin as extension 22 and fin 22' of the stationary post 12'. It is stressed that the arcuate slots of the cross rails 30 and 40 allow for the stationary posts 12, 12' and leg brace 14, 14' to be rotated during construction so that a mutually aligned position between stationary posts and leg braces may be had.

A net 50, shown partly in FIG. 2, is provided and wrapped around the stationary posts and leg braces so as to form a soccer type goal with an open front defined between the leg braces 14, 14', and a closed rear defined between the stationary posts 12, 12'. The net may be adhered or otherwise attached to the stationary posts, but it is generally the case that the mere weight of the net itself is enough for a secure and stable positioning. The net may be made of nylon, or the like. Top knobs 13 and fins 18, 22 serve to hold the net in place when the mesh is passed thereover.

Figure 1:
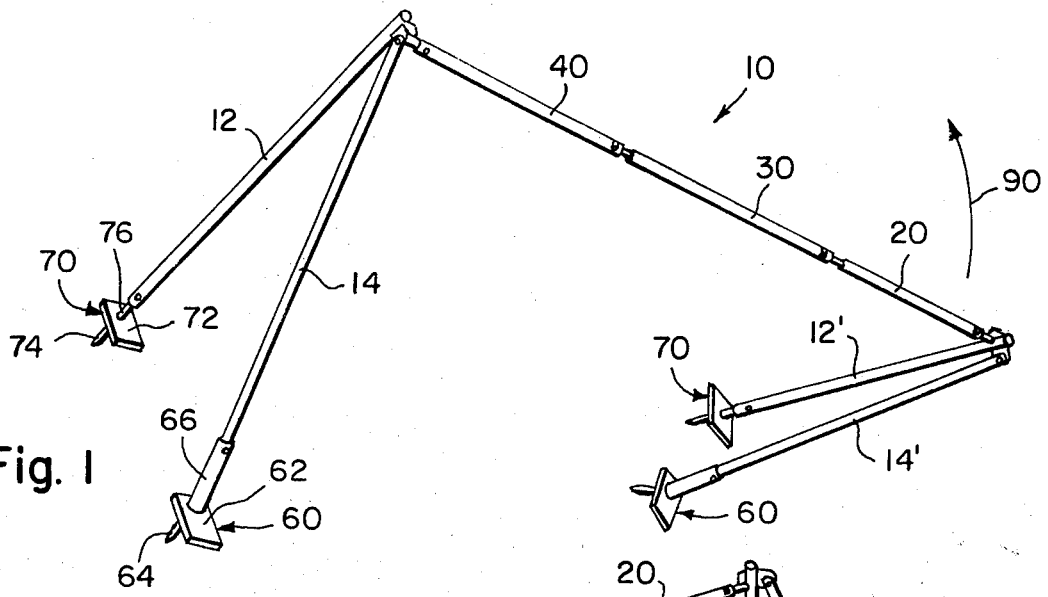

Each stationary post and leg brace is provided, in the preferred form of the invention, with a shoe at its lower end, as shown in FIGS. 1 and 2. Each shoe 60 for the leg braces 14, 14' has a flat face plate 62, a spike 64 extending perpendicularly downwardly from the bottom surface of the face plate 62, and a vertically projecting hollow sleeve 66 extending from the upper surface of the face plate. The sleeve 66 is provided at its end remote from the end connected to the face plate with a circular opening, for receiving therein a snap button provided on the lower end of the leg brace, in a manner similar to that described above with reference to the cross rails. The sleeve 66 projects at an acute angle relative to the upper surface of the face plate, as can be seen in FIG. 2, so that when the leg brace is pivotted outwardly from its respective stationary post, it is easily and telescopingly received within the sleeve 66. Since the angle of inclination of the sleeve 66 is fixed, alignment of the posts and braces is achieved by the relative rotation of the stationary posts about the cross rails, as described above, and by the pivotal movement of each brace relative to its respective stationary post.

Each stationary post 12, 12' is provided with a shoe 70 having a flat face plate 72, a spike 74 and sleeve 76. However, the sleeve 76 is provided with a snap button and is telescopingly received within the lower end of the respective stationary post, which lower end has an opening in a manner as described above with reference to the cross rails. The spikes 64 and 74 are readily and easily inserted into the ground for safe anchoring of the device.

Figure 5:
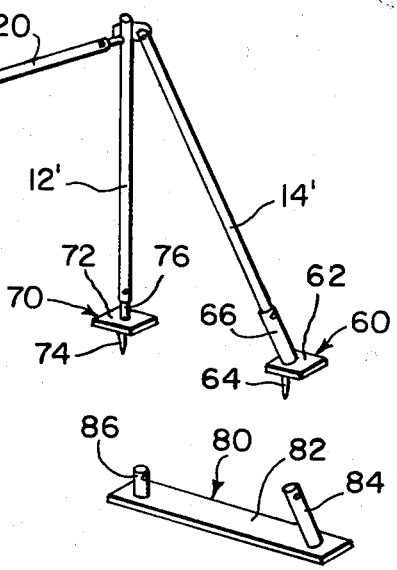
FIG. 5 is a perspective view of a modified form of the support base for the stationary posts of the invention.
Figure 3:
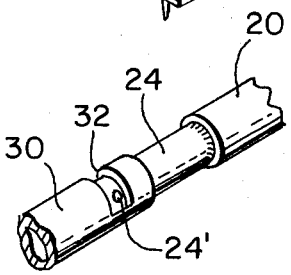
FIG. 3 is a detail view of the snap button joint assembly of the invention.

In a modified form of the invention, instead of the shoes 60 and 70, a pair of floor plates 80 are provided, the structure of which is shown in FIG. 5. The floor plate 80 has a flat face plate 82 and upstanding sleeves 84, 86, which sleeves 84, 86 serve the same function as the sleeves 66, 76. The flat face plate 82 allows for use of the present invention when the goal must be supported on a hard surface, such as cement.

The stationary posts, leg braces, cross rails, and shoes may be made of any hard durable material, such as aluminum. It is stressed that the rotational nature of the stationary posts relative to the cross rails allows for an easy and sure erection of the device. While one side of the goal is being set up such as the stationary posts 12 and leg brace 14, the other end can rest on the ground and then be rotated in the counter-clockwise direction as shown by arrow 90 in FIG. 1.

While specific embodiments of the invention have been shown and described, it is to be understood that numerous changes and modifications may be made therein without departing from the scope and spirit of the invention, as set out in the appended claims. For example, four or more cross rails may be used, as well as two, which will allow for varying the site of the goal opening.

What is claimed is:

1. A portable soccer goal comprising a first end support means; a second end support means; a cross support means having a first end connectable to said first end support means and a second end connectable to said second end support means; a net supportable by said first and second end support means and said cross support means, wherein each of said first and second end support means comprises a stationary post for positioning upright upon a support base, and an elongated brace member having an upper end pivoted to the upper end of said stationary post, wherein said cross support means comprises a plurality of sleeve extensions, a first one of said sleeve extensions being connected at its first end to said upper end of one of said stationary posts, a second one of said plurality of sleeve extensions having a first end connected to the other of said stationary posts at the upper end thereof, each of said first and second sleeve extensions having a second end for connection to another of said plurality of sleeve extensions, wherein said another of said plurality of sleeve extensions has a first end and a projecting tenon extending axially outwardly therefrom, said projecting tenon having a retractable rounded protuberance and a second end, said second end having a positioning slot for reception therein of a retractable rounded protuberance, said slot extending about the circumference of said sleeve an arcuate distance greater than the width of a retractable rounded protuberance which it receives to allow for the rotation of the stationary posts relative to said another sleeve extension, wherein said second end of said first sleeve extension also has an elongated arcuate slot to receive therein said rounded protuberance of said another sleeve extension, wherein said net comprises a first end attached to one of said stationary posts along the length of said post, and a second end connected to the other of said stationary posts along the length of said post, and a middle portion between said first and second ends thereof extending around said elongated brace members along the length of each brace member, said middle portion of said net contacting said brace members on the side thereof facing away from said stationary posts, whereby a front opening is provided defined between the stationary posts, wherein each said stationary post has at its upper end a knob, said knob extending above the plane of said cross support means, and each said stationary post further having a fin adjacent said upper end, whereby said net may be passed thereover to hold it in place.

* * * * *